US009831600B1

(12) United States Patent
Leclerc et al.

(10) Patent No.: US 9,831,600 B1
(45) Date of Patent: Nov. 28, 2017

(54) MAGNETIC VARIABLE-FORCE CONTACTS

(71) Applicant: Apple Inc., Cupertino, CA (US)

(72) Inventors: Michael E. Leclerc, Sunnyvale, CA (US); David H. Narajowski, Los Gatos, CA (US); Brett W. Degner, Menlo Park, CA (US)

(73) Assignee: Apple, Inc., Cupertino, CA (US)

( * ) Notice: Subject to any disclaimer, the term of this patent is extended or adjusted under 35 U.S.C. 154(b) by 0 days.

(21) Appl. No.: 15/275,216

(22) Filed: Sep. 23, 2016

(51) Int. Cl.
*H01R 13/62* (2006.01)
*H01R 13/629* (2006.01)
*H01R 13/15* (2006.01)

(52) U.S. Cl.
CPC ..... *H01R 13/6205* (2013.01); *H01R 13/15* (2013.01); *H01R 13/629* (2013.01)

(58) Field of Classification Search
CPC ... H01R 13/6205; H01R 13/629; H01R 13/15
USPC .... 439/38, 39, 129, 305, 700, 743, 824, 837
See application file for complete search history.

(56) References Cited

U.S. PATENT DOCUMENTS 2,919,323 A * 12/1959 Drescher ..... H01H 51/065 335/82
3,521,216 A * 7/1970 Tolegian ..... H01R 13/6205 439/152
6,464,509 B1 * 10/2002 Emberty ..... H01R 13/6205 439/38
7,311,526 B2 * 12/2007 Rohrbach ..... H01R 13/6205 439/218
7,914,348 B1 * 3/2011 Lin ..... H01R 12/57 439/700
8,062,078 B2 * 11/2011 Asai ..... H01R 13/2421 439/482
8,449,304 B1 * 5/2013 Lin ..... H01R 13/6205 439/39
8,905,795 B2 * 12/2014 Kim ..... H01R 13/62 439/482
2007/0138806 A1 * 6/2007 Ligtenberg ..... E05C 19/16 292/251.5
2008/0280461 A1 * 11/2008 DiFonzo ..... H01R 13/641 439/39
2012/0199770 A1 * 8/2012 Alessandro ..... F16K 11/07 251/129.15

* cited by examiner

*Primary Examiner* — Harshad Patel
(74) *Attorney, Agent, or Firm* — Kilpatrick Townsend & Stockton, LLP

(57) ABSTRACT

Variable-force contacts that may provide a large and stable contact force in a mated state, may provide a large difference in contact force between the mated and an unmated state, and may reduce stray flux in an unmated state. Examples may replace physical springs with magnetic force for improved reliability. These examples may position the magnets to reduce stray flux in an unmated state.

20 Claims, 12 Drawing Sheets

MAGNETIC VARIABLE-FORCE CONTACTS

BACKGROUND

The number and types of electronic devices available to consumers have increased tremendously the past few years and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive power and share data using cables that may have connector inserts on each end. The connector inserts may plug into connector receptacles on electronic devices, thereby forming one or more conductive paths for signals and power. Other devices may have connectors at a surface of a device. These devices may be connected to each other by placing them next to each other such that their connectors form electrical connections.

These various connectors may include various types of contacts. A variable-force contact may be used in either a connector insert or a connector receptacle, or it may be used in a connector at a surface of a device.

Spring-loaded contacts are an example of a variable-force contact. But conventional spring-loaded contacts may provide a contact force when mated to corresponding contacts that may vary considerably. For example, manufacturing tolerances may change one or more dimensions among conventional spring-loaded contacts in a group. The changes brought about by these manufacturing tolerances may lead to changes and inconsistencies in contact force, which may lead to changes and inconsistencies in contact resistance.

Also, springs in conventional spring-loaded contacts may provide a similar force when in a mated and unmated state. This may mean that the springs provide excessive force when unmated and insufficient force when mated.

Thus, what is needed are variable-force contacts that may provide a high and stable contact force in a mated state and may provide a large difference in contact force between the mated and an unmated state.

SUMMARY

Accordingly, embodiments of the present invention may provide variable-force contacts that may provide a high and stable contact force in a mated state and may provide a large difference in contact force between the mated and an unmated state. Various embodiments of the present invention may replace physical springs with magnetic force for improved reliability. These and other embodiments of the present invention may position the magnets to reduce stray flux in an unmated state.

An embodiment of the present invention may provide a variable-force contact. The variable-force contact may include a housing. The housing may be separate from a device enclosure or it may be the same as a device enclosure, or structures may be shared between the housing and device enclosure. A barrel may extend laterally through the housing. The barrel may include a rear portion located in the housing and a front portion extending from a front of the housing. A plunger may be located at least partially in the barrel. The plunger may have a contacting surface. The contacting surface of the plunger may extend beyond a front of the barrel. The contacting surface may mate with corresponding contact surfaces of corresponding contacts in corresponding connectors. The plunger may be free to move laterally within the barrel.

In these and other embodiments of the present invention, two magnets may be used to provide a contact force at the connecting surface of the plunger. The two magnets may include a contact magnet in the barrel between the plunger and a rear of the barrel. The contact magnet may be free to move laterally within the barrel. The two magnets may further include a shuttle magnet. The shuttle magnet may be located on at least a first side of the barrel. The shuttle magnet may be free to move laterally within the housing. In one specific example, the contact magnet and shuttle magnet may be oriented to each other to provide a repelling force. That is, a North pole of the contact magnet may face a North pole of the shuttle magnet, or a South pole of the contact magnet may face a South pole of the shuttle magnet.

In these and other embodiments of the present invention, the shuttle magnet may be located on a first side and a second side of the barrel, the first side opposite the second side. In these and other embodiments of the present invention, the shuttle magnet and the contact magnet may be concentric. When they are concentric, the shuttle magnet may include a first passage and the barrel may be located in the first passage.

In these and other embodiments of the present invention, when the variable-force contact is unmated, the shuttle magnet and the contact magnet may repel such that the shuttle magnet moves laterally towards the rear of the housing. The contact magnet and plunger may be driven such that they are positioned at a front the barrel. In this configuration, the shuttle magnet and the contact magnet may be at or near a maximum distance or spacing for that particular variable-force contact. This may reduce a contact force at the contacting surface of the plunger in the unmated state. This may help to avoid an amount of incidental wear and prevent damage to the variable-force contact. For example, the variable-force contact may retract and avoid damage when it is hit or struck by an object. The presence of some force may ensure that the plunger remains in contact with an end of the barrel in an unmated state. This may prevent contaminants from entering the barrel of the variable-force contact.

In these and other embodiments of the present invention, when the variable-force contact is mated to a corresponding contact, the shuttle magnet may be attracted to a front of the housing by a magnetic element of a corresponding connector. The contact magnet may be repelled such the contact magnet and plunger are positioned at a front of the barrel. In this configuration, the shuttle magnet and the contact magnet may be at or near a minimum distance or spacing for that particular variable-force contact. This may increase a contact force at the contacting surface of the plunger in the mated state. This increase in force may reduce an impedance of a connection made between the variable-force contact and a corresponding contact. This mated contact force may be larger than the unmated contact force.

In these and other embodiments of the present invention, the mated force may be a function of the repelling magnetic force between the contact magnet and the shuttle magnet. In the mated configuration, the contact magnet may be in a passage in the shuttle magnet. The result may be that the repelling magnetic force may be a weak function of the exact placement of the contact magnet relative to the shuttle magnet. This may provide a stable contact force as the sizes and spacings of the component parts of the variable-force contact vary over manufacturing tolerances.

In these and other embodiments of the present invention, the variable-force contact may generate only a limited, reduced, or zero force pushing against its housing. This may stand in contrast to spring-loaded contacts that may include a spring that may push a device housing the spring-loaded contact away from a corresponding mated device. This pushing may reduce a resulting contact force. By removing this push force provided by the spring, the resulting contact force may be maintained at a high level when the variable-force contact is mated.

In these and other embodiments of the present invention, when the variable-force contact is unmated, the shuttle magnet may be driven by the repelling magnetic force of the contact magnet to a rear of the housing. In this position, the larger shuttle magnet may be further away from a surface of an electronic device housing the variable-force contact. This may reduce stray magnetic flux at a surface of the electronic device in the unmated state. This may protect against damage to magnetic stripes on credit cards and licenses and may prevent data loss in various data storage media.

In these and other embodiments of the present invention, it may be desirable that when the variable-force contact is mated, current may flow through the plunger and into a barrel. That is, it may be undesirable in the mated state for the plunger to be centered in the barrel and not contacting an inside edge of the barrel, as this would create an open circuit. Accordingly, in these and other embodiments of the present invention, a backside of the plunger may be asymmetrical. This may help to prevent the plunger from being centered in the barrel and creating an open circuit by having the contact magnet push an edge of the plunger into a side of the barrel.

In these and other embodiments of the present invention, no physical spring may be present. This may help to avoid problems where springs may become tangled or where they may be destroyed by excessive current flow. The elimination of a spring may improve the reliability of a variable-force contact, though these and other embodiments of the present invention may continue to make use of a spring.

Another embodiment of the present invention may provide another variable-force contact. The variable-force contact may include a housing. The housing may be separate from a device enclosure or it may be the same as a device enclosure, or structures may be shared between the housing and device enclosure. A barrel may extend laterally through the housing. The barrel may include a rear portion located in the housing and a front portion extending from a front of the housing. A plunger may be located at least partially in the barrel. The plunger may have a contacting surface. The contacting surface may extend beyond a front of the barrel. The contacting surface may mate with corresponding contact surfaces of corresponding contacts in corresponding connectors. The plunger may be free to move laterally within the barrel.

In these and other embodiments of the present invention, two magnets may be used to provide a contact force at the connecting surface of the plunger. As before, the two magnets may include a contact magnet in the barrel between the plunger and a rear of the barrel. The contact magnet may be free to move laterally within the barrel. The two magnets may further include a shuttle magnet. The shuttle magnet may be located on at least a first side of the barrel. The shuttle magnet may be free to move laterally within the housing.

In these and other embodiments of the present invention, the shuttle magnet may be located on a first side and a second side of the barrel, the first side opposite the second side. In these and other embodiments of the present invention, the shuttle magnet and the contact magnet may be concentric. When they are concentric, the shuttle magnet may include a first passage and the barrel may be located in the first passage.

In these and other embodiments of the present invention, a protective structure may be used to protect the contact magnet from the spring. This protective structure may be conductive or nonconductive. It may be located in the barrel between the spring and the contact magnet. It may be free to move laterally in the barrel. It may be attached to the contact magnet or it may be free to move relative to the contact magnet. The protective structure may include a tail portion substantially surrounded by the spring. This may keep the spring aligned to the protective structure and may help to keep the spring from being tangled with the protective structure. On its opposite end, the spring may terminate in a recess in a back surface of the plunger, which may help to keep the spring from becoming tangled with the plunger.

In one specific example, instead of being oriented to provide a repelling force as in the above example, the contact magnet and shuttle magnet may be oriented to each other to provide an attractive force. That is, a North pole of the contact magnet may face a South pole of the shuttle magnet, or a South pole of the contact magnet may face a North pole of the shuttle magnet.

In these and other embodiments of the present invention, when the variable-force contact is unmated, the spring may push the contact magnet away from the plunger. The shuttle magnet and the contact magnet may attract each other. The shuttle magnet may move laterally such that the contact magnet is near a center of the shuttle magnet. In this configuration, the shuttle magnet and the contact magnet may be at or near a minimum distance or spacing for that particular variable-force contact. This may reduce a contact force at the contacting surface of the plunger in the unmated state. This may help to avoid an amount of incidental wear and prevent damage to the variable-force contact. For example, the variable-force contact may retract and avoid damage when it is hit or struck by an object. The presence of some force may ensure that the plunger remains in contact with an end of the barrel in an unmated state. This may prevent contaminants from entering the barrel of the variable-force contact.

In these and other embodiments of the present invention, when the variable-force contact is mated, the shuttle magnet may be attracted to a front of the housing by a magnetic element of a corresponding contact. The contact magnet may be attracted to the shuttle contact such the contact magnet and plunger are positioned at a front of the barrel. In this configuration, the shuttle magnet and the contact magnet may be at or near a maximum distance or spacing for that particular variable-force contact. This may increase a contact force at the contacting surface of the plunger in the mated state. This increase in force may reduce an impedance of a connection made between the variable-force contact and a corresponding contact. This mated contact force may be larger than the unmated contact force.

In these and other embodiments of the present invention, the mated force may be a function of the attractive magnetic force between the contact magnet and the shuttle magnet. In the mated configuration, the contact magnet may be in a passage in the shuttle magnet. The result may be that the attractive magnetic force may be a weak function of the exact placement of the contact magnet relative to the shuttle magnet. This may provide a stable contact force as the sizes and spacings of the component parts of the variable-force contact vary over manufacturing tolerances.

In these and other embodiments of the present invention, the variable-force contact may generate only a limited, reduced, or zero force pushing against its housing. This may stand in contrast to spring-loaded contacts that may include a spring that may push a device housing the spring-loaded contact away from a corresponding mated device. This pushing may reduce a resulting contact force. By removing this push force provided by a spring, the resulting contact force may be maintained at a high level when the variable-force contact is mated.

In these and other embodiments of the present invention, when the variable-force contact is unmated, the shuttle magnet may be driven by the attractive magnetic force of the contact magnet to a location near a rear of the housing. In this position, the larger shuttle magnet may be further away from a surface of an electronic device housing the variable-force contact. This may reduce stray magnetic flux at a surface of the electronic device in the unmated state. This may protect against damage to magnetic stripes on credit cards and licenses and may prevent data loss in various data storage media.

In these and other embodiments of the present invention, it may be desirable that when the variable-force contact is mated, current may flow through the plunger and into a barrel. That is, it may be undesirable in the mated state for the plunger to be centered in the barrel and not contacting an inside edge of the barrel, as this would create an open circuit. Accordingly, in these and other embodiments of the present invention, a surface of the protective structure closest to the plunger may be asymmetrical. In these and other embodiments of the present invention, a backside of the plunger may be asymmetrical instead of the surface of the protective structure. Either of these may help to prevent the plunger from being centered in the barrel and creating an open circuit by having the contact magnet push an edge of the plunger into a side of the barrel.

Another embodiment of the present invention may provide another variable-force contact. The variable-force contact may include a housing. The housing may be separate from a device enclosure or it may be the same as a device enclosure, or structures may be shared between the housing and device enclosure. A barrel may extend laterally through the housing. The barrel may include a rear portion located in the housing and a front portion extending from a front of the housing. A plunger may be located at least partially in the barrel. The plunger may have a contacting surface that may extend beyond a front of the barrel. The contacting surface may mate with corresponding contact surfaces of corresponding contacts in corresponding connectors. The plunger may be free to move laterally within the barrel. A magnet may be located in the barrel. When a connection is made to a corresponding contact, the magnet may be attracted to a magnetic element in the corresponding connector. The magnet may move forward against the plunger thereby providing a high contacting force in the mated state.

This variable-force contact may include a spring between magnet and the plunger. When the variable-force contact is in the unmated state, the spring may push the magnet away from the plunger. This may reduce a contact force at the plunger in the unmated state. The repositioning of the magnet away from the front of the variable-force contact may reduce the stray magnetic flux at a surface of the device.

In various embodiments of the present invention, plungers, barrels contacts, brackets, barrels, and other conductive portions of a variable-force contact may be formed by stamping, forging, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The magnets may be rare-earth magnets or other type of magnets.

Embodiments of the present invention may provide variable-force contacts that may be used in connector receptacles and connector inserts that may be located in, may connect to, or may be on the surface of various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, styluses, remote control devices, chargers, and other devices. These variable-force contacts may provide pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector structures that may be used to provide a reduced set of functions for one or more of these standards. In various embodiments of the present invention, these variable-force contacts may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
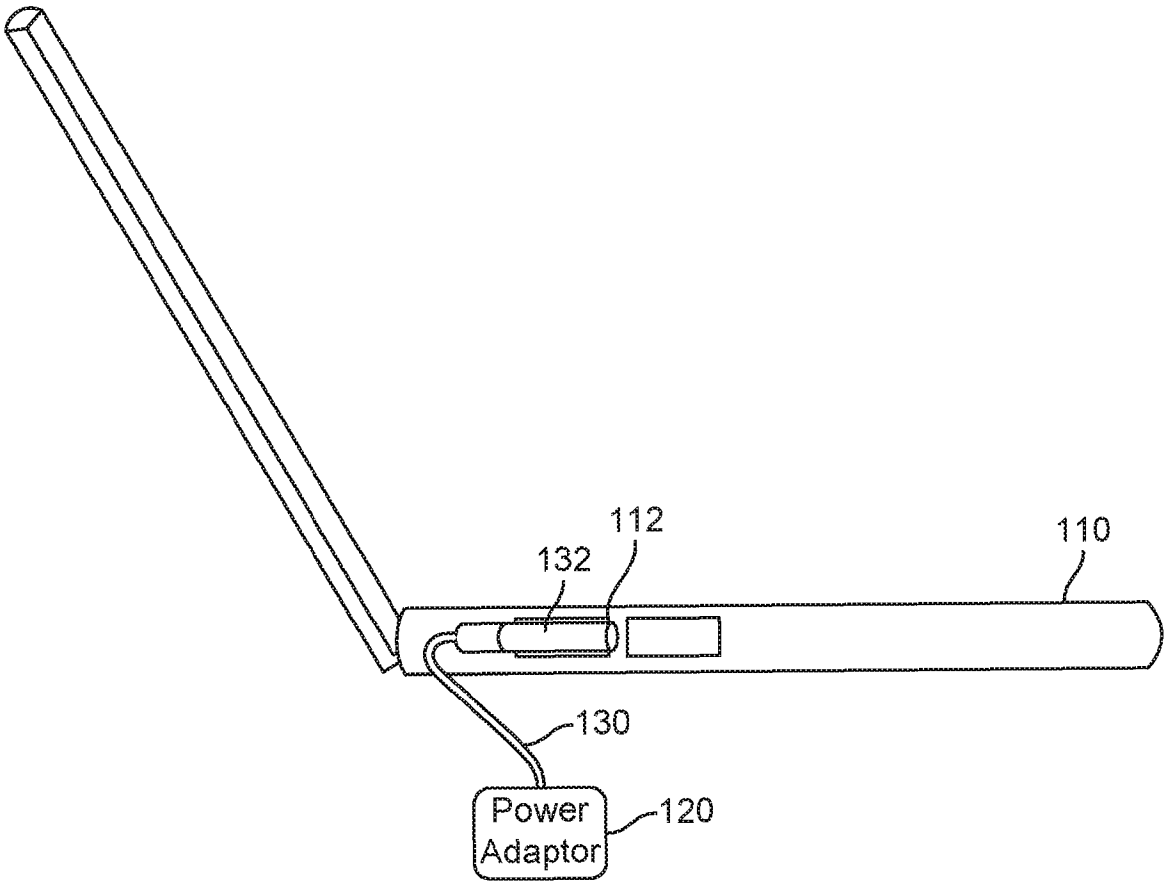
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

This figure includes electronic device 110. In this specific example, electronic device 110 may be a laptop computer. In other embodiments of the present invention, electronic device 110 may be a tablet computer, cell, media, or smart phone, global positioning device, media player, or other device.

Electronic device 110 may include a battery. The battery may provide power to electronic circuits in electronic device 110. This battery may be charged using power adapter 120. Specifically, power adapter 120 may receive power from an external source, such as a wall outlet or car charger. Power adapter 120 may convert received external power, which may be AC or DC power, to DC power, and it may provide the converted DC power over cable 130 to connector insert 132. In other embodiments of the present invention, connector insert 132 may be coupled through cable 130 to another type of device. Connector insert 132 may be arranged to mate with connector receptacle 112 on electronic device 110. Power may be received at connector receptacle 112 from connector insert 132 and provided to the battery and electronic circuitry in electronic device 110. In other embodiments of the present invention, data or other types of signals may also be provided to electronic device 110 via connector insert 132. Power and data may be transferred using variable-force contacts according to embodiments of the present invention. These contacts may be located in connector insert 132, connector receptacle 112, or on the surface of an electronic device, such as electronic device 110. Another connector insert that may include variable-force contacts is shown in the following figure.

Figure 2:
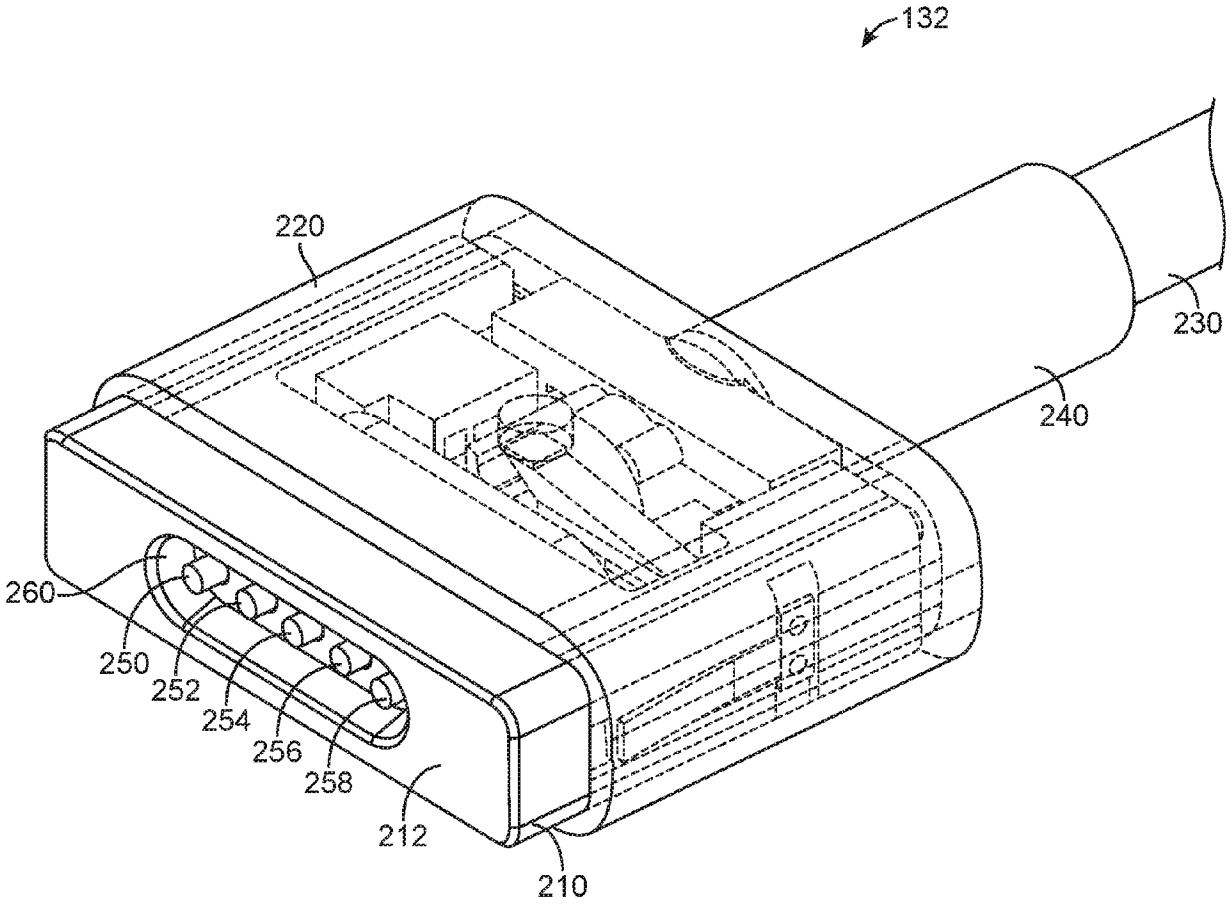
FIG. 2 illustrates a connector insert according to an embodiment of the present invention.

FIG. 2 illustrates a connector insert 132 according to an embodiment of the present invention. Connector insert 132 may include an attraction plate 210, shield or cover 220, cable 230, and strain relief 240. Attraction plate 210 may include front surface 212. Front surface 212 may include opening 260 for contacts 250, 252, 254, 256, and 258. In a specific embodiment of the present invention, contacts 250 and 258 may convey ground, contacts 252 and 256 may convey power, while contact 254 may be used to detect that a connection has been formed. In this specific example, contacts 250 and 258 protrude in front of the other contacts, such that ground paths are formed before power is applied when connector insert 132 is mated with a corresponding connector receptacle.

In various embodiments of the present invention, contacts 250, 252, 254, 256, and 258 may be variable-force contacts. Examples of variable-force contacts according to embodiments of the present invention are shown in the following figures.

Again, embodiments of the present invention may provide variable-force contacts that may provide a high and stable contact force in a mated state and may provide a large difference in contact force between the mated and an unmated state. Various embodiments of the present invention may replace physical springs with magnetic force for improved reliability. These and other embodiments of the present invention may position these magnets to provide a reduced stray flux in an unmated state. Examples are shown in the following figures.

Figure 3:
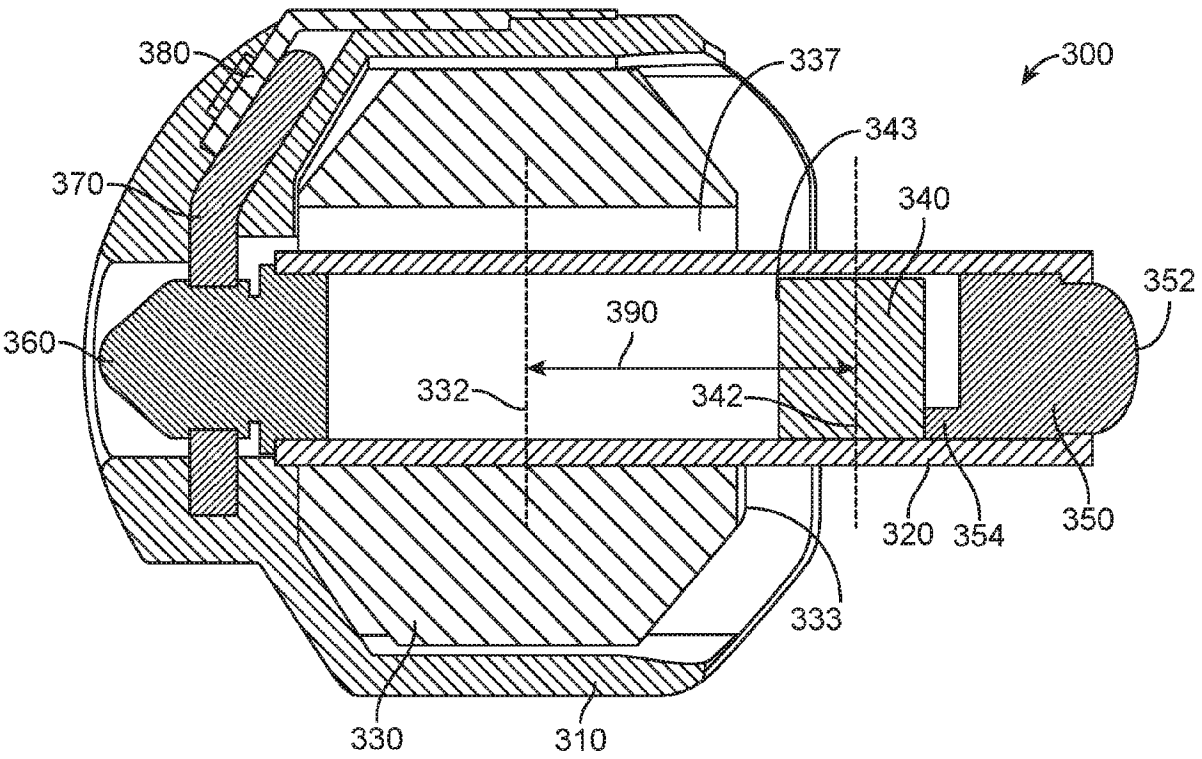
FIG. 3 illustrates a variable-force contact according to an embodiment of the present invention.

FIG. 3 illustrates a variable-force contact according to an embodiment of the present invention. Variable-force contact 300 may include housing 310. Housing 310 may be separate from a device enclosure (not shown) or it may be the same as a device enclosure, or structures (not shown) may be shared between housing 310 and a device enclosure. Barrel 320 may extend laterally through housing 310. Barrel 320 may include a rear portion located in housing 310 and a front portion extending from a front of housing 310. Plunger 350 may be located at least partially in barrel 320. Plunger 350 may have contacting surface 352. Contacting surface 352 may extend beyond barrel 320 and may mate with corresponding contact surfaces of corresponding contacts in corresponding connectors. Plunger 350 may be free to move laterally within barrel 320. Barrel 320 may terminate in barrel contact 360. Bracket 370 may connect to barrel contact 370 and may further connect to flexible circuit board 380. In this way, power, data, ground, or other signals or voltage may be transferred between device via a path including plunger 350, barrel 320, barrel contact 360, bracket 370, and flexible circuit board 380.

In this example, two magnets may be used to provide a contact force at contacting surface 352 of plunger 350. The two magnets may include contact magnet 340 in barrel 320 between plunger 350 and barrel contact 360. Contact magnet 340 may be free to move laterally within barrel 320. The two magnets may further include shuttle magnet 330. Shuttle magnet 330 may be located on at least a first side of barrel 320. Shuttle magnet 330 may be free to move laterally within housing 310. In one specific example, contact magnet 340 and shuttle magnet 330 may be oriented relative to each other in order to provide a repelling force. That is, a North pole of contact magnet 340 may face a North pole of shuttle magnet 330, or a South pole of contact magnet 340 may face a South pole of shuttle magnet 330. In this example, face 343 of contact magnet and face 333 of shuttle magnet 330 may have the same poles.

In these and other embodiments of the present invention, shuttle magnet 330 may be located on a first side and a second side of barrel 320, the first side opposite the second side. In these and other embodiments of the present invention, shuttle magnet 330 and the contact magnet 340 may be concentric. When they are concentric, shuttle magnet 330 may include a first passage 337 and barrel 320 may be located in the first passage 337.

In these and other embodiments of the present invention, when variable-force contact 300 is unmated, shuttle magnet 330 and contact magnet 340 may repel such that shuttle magnet 330 moves laterally towards the rear of housing 310. Contact magnet 340 and plunger may be driven such that they are positioned at a front barrel 320. In this configuration, shuttle magnet 330 and contact magnet 340 may be at or near a maximum distance or spacing for variable-force contact 300. That is, distance 390 from center line 342 of contact magnet 340 to center line 332 of shuttle contact 330 may be at or near a maximum for variable-force contact 300. This may reduce a contact force at contacting surface 352 of plunger 350 in the unmated state. This may help to avoid incidental wear and prevent damage to variable-force contact 300. For example, plunger 350 of variable-force contact 300 may retract and avoid damage when it is hit or struck by an object. The presence of some force may ensure that plunger 350 remains in contact with an end of barrel 320 in an unmated state. This may prevent contaminants from entering barrel 320 of variable-force contact 300.

Figure 4:
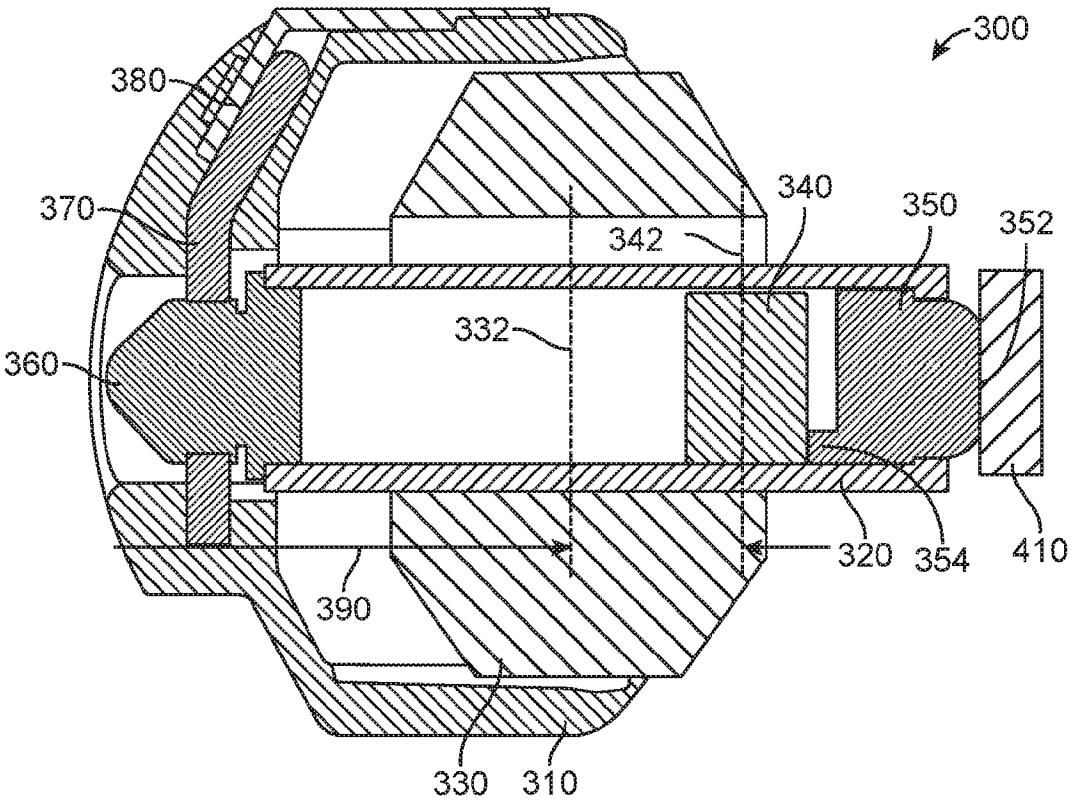
FIG. 4 illustrates the variable-force contact of FIG. 3 in a mated state.

FIG. 4 illustrates the variable-force contact of FIG. 3 in a mated state. In these and other embodiments of the present invention, when variable-force contact 300 is mated with contact 410, shuttle magnet 330 may be attracted to a front of housing 310 by a magnetic element of a corresponding connector that includes corresponding contact 410. Contact magnet 340 may be repelled such contact magnet 340 and plunger are positioned at a front of barrel 320. In this configuration, shuttle magnet 330 and contact magnet 340 may be at or near a minimum distance or spacing for variable-force contact 300. That is, distance 390 from center line 342 of contact magnet 340 to center line 332 of shuttle contact 330 may be at or near a minimum for this variable-force contact 300. This may increase a contact force at contacting surface 352 of plunger 350 in the mated state. This increase in force may reduce an impedance of a connection made between variable-force contact 300 and corresponding contact 410. This mated contact force may be larger than the unmated contact force.

In these and other embodiments of the present invention, the mated force may be a function of the repelling magnetic force between contact magnet 340 and shuttle magnet 330. In the mated configuration, contact magnet 340 may be in a passage 337 in shuttle magnet 330. The result may be that the repelling magnetic force may be a weak function of the exact placement of contact magnet 340 relative to shuttle magnet 330. This may provide a stable contact force as the sizes and spacings of the component parts of variable-force contact 300 vary over manufacturing tolerances.

In these and other embodiments of the present invention, variable-force contact 300 may generate only a limited, reduced, or zero force pushing against its housing. This may stand in contrast to spring-loaded contacts that may include a spring that may push a device housing the spring-loaded contact away from a corresponding mated device. This pushing may reduce a resulting contact force. By removing this pushing, the resulting contact force may be maintained at a high level when variable-force contact 300 is mated.

In these and other embodiments of the present invention, when variable-force contact 300 is unmated, shuttle magnet 330 may be driven by the repelling magnetic force of contact magnet 340 to a rear of housing 310. In this position, the larger shuttle magnet 330 may be further away from a surface of an electronic device housing variable-force contact 300. This may reduce stray magnetic flux at a surface of the electronic device in the unmated state. This in turn may protect against damage to magnetic stripes on credit cards and licenses and may prevent data loss in various data storage media.

In these and other embodiments of the present invention, it may be desirable that when variable-force contact 300 is mated, current may flow through plunger 350 and into barrel 320. That is, it may be undesirable in the mated state for plunger 350 to be centered in barrel 320 and not contacting an inside edge of barrel 320, as this would create an open circuit. Accordingly, in these and other embodiments of the present invention, a backside of plunger 350 may be asymmetrical, as shown here and in FIG. 3 by the inclusion of feature 354. This may help to prevent plunger 350 from being centered in barrel 320 and creating an open circuit by having contact magnet 340 push an edge of plunger 350 into a side of barrel 320.

Figure 5:
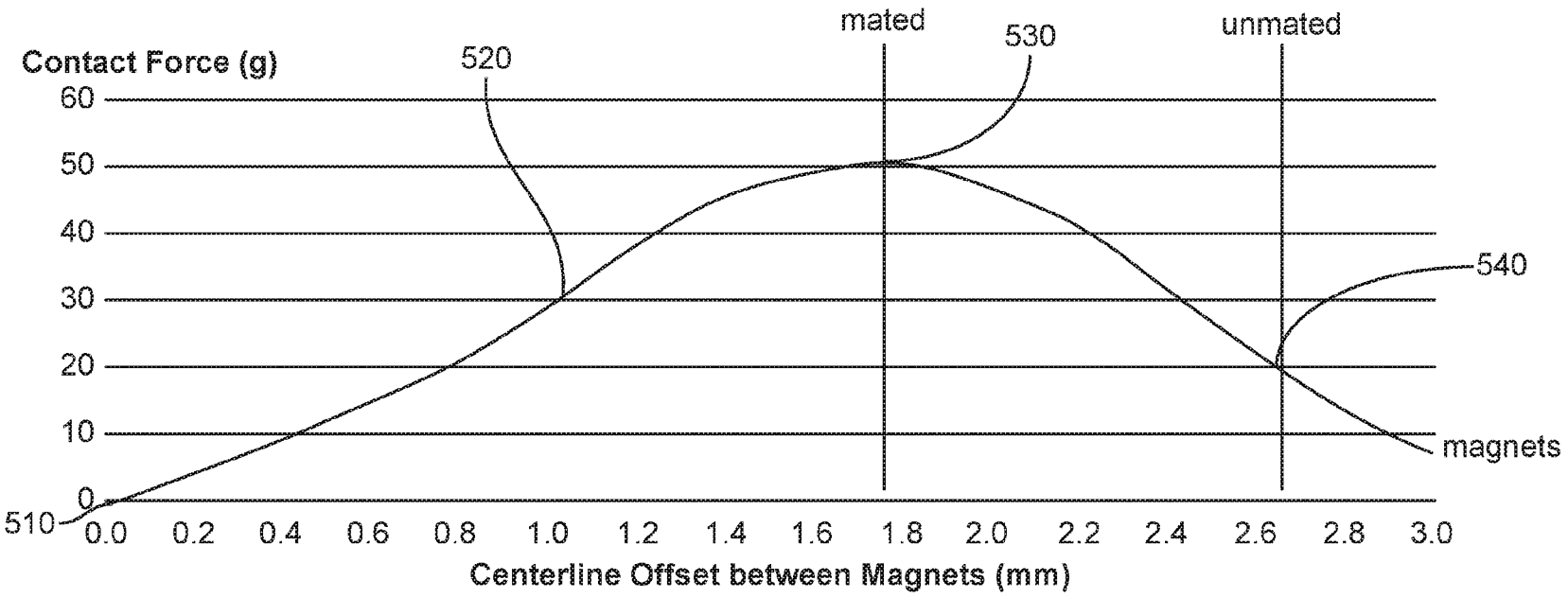
FIG. 5 illustrates a contact force curve for the magnets of the variable-force contact of FIG. 3.

FIG. 5 illustrates a contact force curve for the magnets of the variable-force contact of FIG. 3. This force curve graphs a force available at contacting surface 352 of plunger 350 as a function of a distance between center lines of contact magnet 340 and shuttle magnet 330. In this example, at point 510, contact magnet 340 may be centered in shuttle magnet 330 and thought the magnets repel, there is no net force on the magnet. As contact magnet 340 moves out towards and edge and out of shuttle magnet 330, the force may increase as shown by line segment 520. A mating force is shown at point 530. The rate of change of contact force near point 530 (the derivative of the curve at point 530) may be flat, meaning that changes in the distance between centerlines of contact magnet 340 and shuttle magnet 330 might not strongly effect contact force. This may allow variations in components size and spacings that may be due to manufacturing tolerances and other variables to have a limited effect on contact force. The high value may reduce contact resistance in the connection between variable-force contact 300 and contact 410. When variable-force contact 300 is disconnected from contact 410, the distance between centerlines of contact magnet 340 and shuttle magnet 330 may increase to point 540. Point 540 may show the unmated contact force for variable-force contact 300. This low contact force may help to avoid incidental wear and prevent damage to variable-force contact 300.

Figure 6:
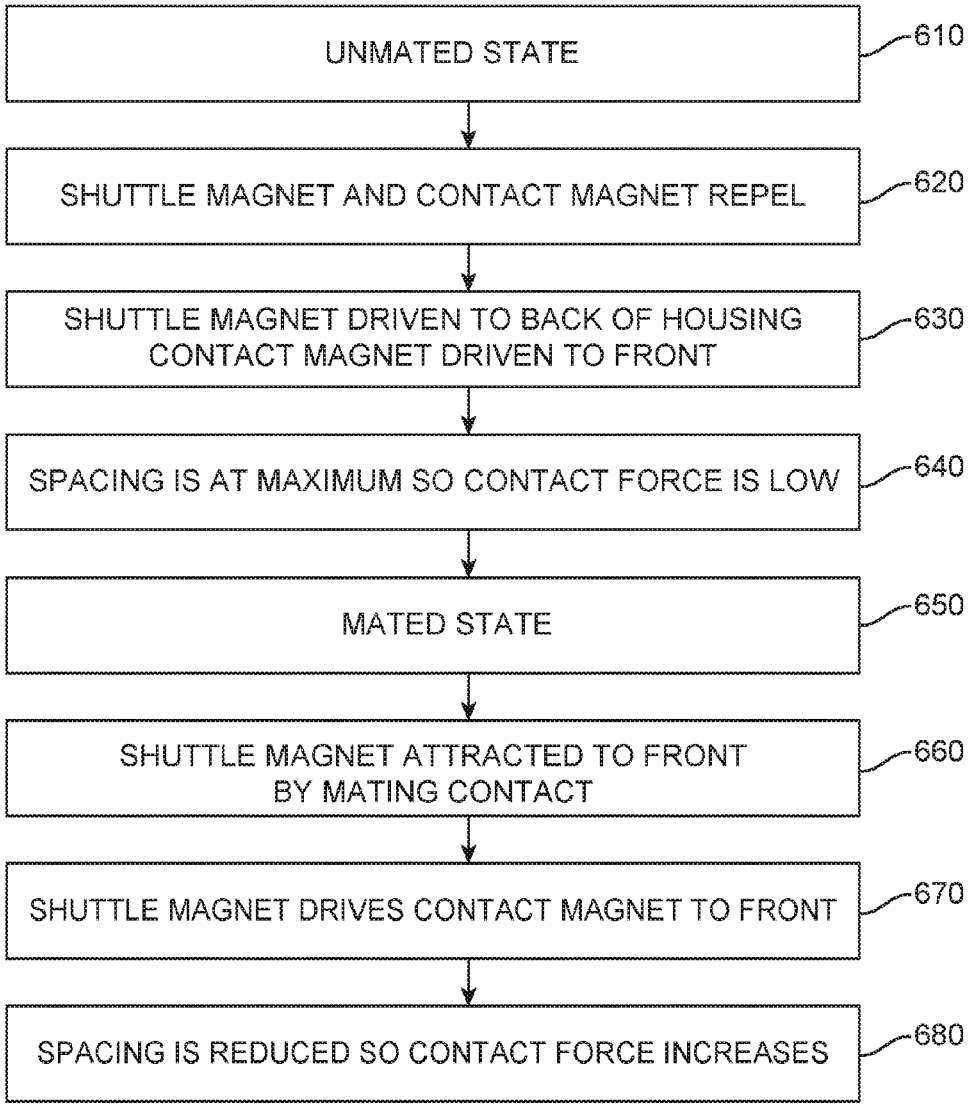
FIG. 6 is a flow chart showing the operation of the variable-force contact of FIG. 3.

FIG. 6 is a flow chart showing the operation of the variable-force contact of FIG. 3. In act 610, variable-force contact 300 may be unmated. In act 620, contact magnet 340 and shuttle magnet 330 may repel. Shuttle magnet 340 may be driven to a rear of housing 310 in act 630. Again, this may reduce stray flux at a surface of an electronic device housing variable-force contact 300. In act 340, the distance between center lines 342 and 332 of contact magnet 340 and shuttle magnet 330 may be at a maximum thereby reducing the contact force.

In act 650, variable-force contact 300 may be mated. Shuttle magnet 330 may be attracted to a front of variable-force contact 300 by a magnetic element of a connector having mating contact 410, in act 660. Shuttle magnet 330 may drive contact magnet 340 forward in act 670. The distance between center lines 342 and 332 of contact magnet 340 and shuttle magnet 330 may be at a minimum thereby increasing the contact force in act 680. Again, this increased force may reduce a resistance of the connection between variable-force contact 300 and mating contact 410.

Figure 7:
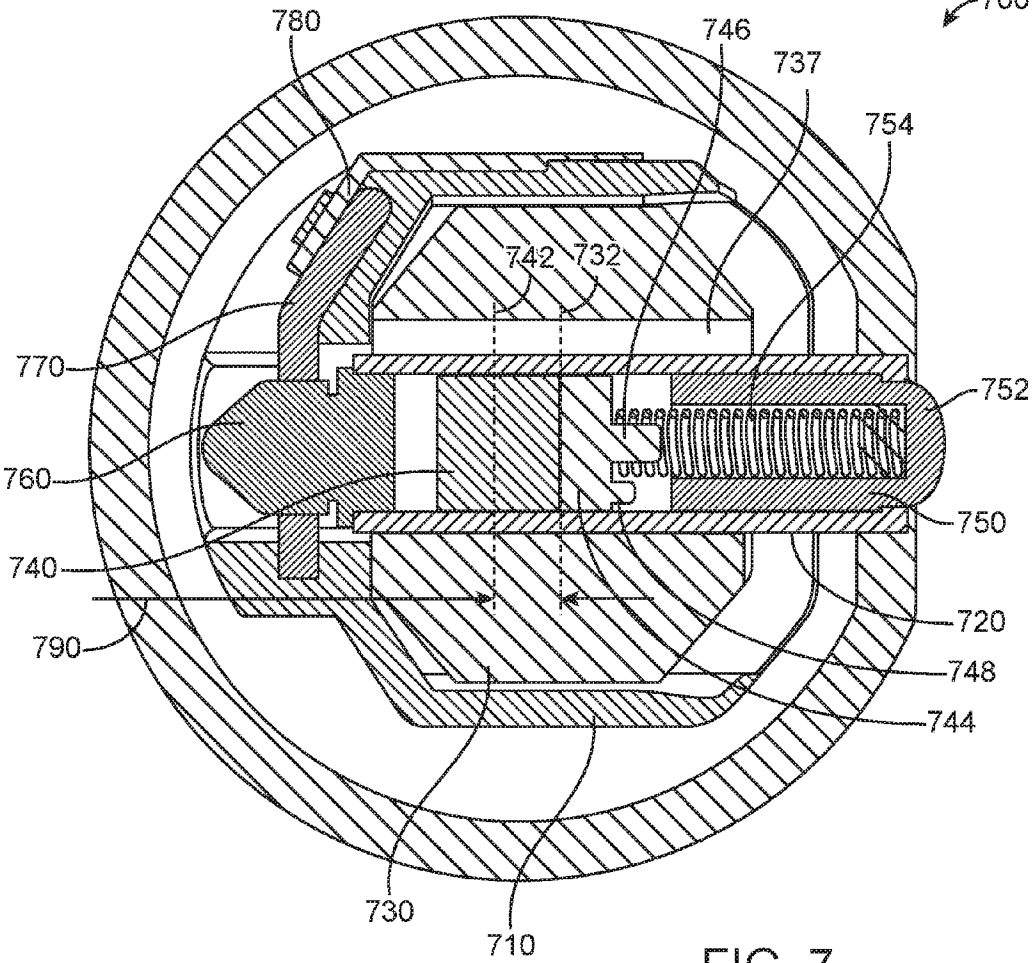
FIG. 7 illustrates another variable-force contact according to an embodiment of the present invention.

FIG. 7 illustrates another variable-force contact according to an embodiment of the present invention. Variable-force contact 700 may include housing 710. Housing 710 may be separate from a device enclosure or it may be the same as a device enclosure, or structures may be shared between housing 710 and device enclosure. Barrel 720 may extend laterally through housing 710. Barrel 720 may include a rear portion located in housing 710 and a front portion extending from a front of housing 710. Plunger 750 may be located at least partially in barrel 720. Plunger 750 may have contacting surface 752. Contacting surface 752 may extend beyond a front of plunger 750. Contacting surface 752 may mate with corresponding contact surfaces of corresponding contacts in corresponding connectors. Plunger 750 may be free to move laterally within barrel 720. Barrel 720 may terminate in barrel contact 760. Bracket 770 may connect to barrel contact 770 and may further connect to flexible circuit board 780. In this way, power, data, ground, or other signals or voltage may be transferred between device via a path including plunger 750, barrel 720, barrel contact 760, bracket 770, and flexible circuit board 780.

In these and other embodiments of the present invention, two magnets may be used to provide a contact force at the connecting surface of plunger 750. As before, the two magnets may include contact magnet 740 in barrel 720 between plunger 750 and a rear of barrel 720. Contact magnet 740 may be free to move laterally within barrel 720. The two magnets may further include a shuttle magnet. Shuttle magnet 730 may be located on at least a first side of barrel 720. Shuttle magnet 730 may be free to move laterally within housing 710.

In these and other embodiments of the present invention, shuttle magnet 730 may be located on a first side and a second side of barrel 720, the first side opposite the second side. In these and other embodiments of the present invention, shuttle magnet 730 and the contact magnet 740 may be concentric. When they are concentric, the shuttle magnet may include a first passage 737 and barrel 720 may be located in the first passage 737.

In these and other embodiments of the present invention, a protective structure 744 may be used to protect contact magnet 740 from spring 754. This protective structure 744 may be conductive or nonconductive. It may be located in barrel 720 between spring 754 and contact magnet 740. It may be free to move laterally in barrel 720. It may be attached to contact magnet 740 or it may be free to move relative to contact magnet 740. The protective structure 744 may include a tail portion 746 substantially surrounded by spring 754. This may keep spring 754 aligned to the protective structure 744 and may help to keep spring 754 from being tangled with the protective structure 744. On its opposite end, spring 754 may terminate in a recess in a back surface of plunger 750, which may help to keep spring 754 from becoming tangled with plunger 750.

In one specific example, instead of being oriented to provide a repelling force as in the above example, contact magnet 740 and shuttle magnet may be oriented to each other to provide an attractive force. That is, a North pole of contact magnet 740 may face a South pole of shuttle magnet 730, or a South pole of contact magnet 740 may face a North pole of shuttle magnet 730. In this example, face 743 of contact magnet and face 733 of shuttle magnet 330 have opposite poles.

In these and other embodiments of the present invention, when the variable-force is unmated, spring 754 may push contact magnet 740 away from plunger 750. Shuttle magnet 730 and contact magnet 740 may attract each other. Shuttle magnet 730 may move laterally such that contact magnet 740 is near a center of shuttle magnet 730. In this configuration, shuttle magnet 730 and contact magnet 740 may be at or near a minimum distance or spacing for variable-force contact 700. That is, distance 790 between center line 732 of shuttle magnet 730 and center line 742 of contact magnet 740 may be at or near a minimum distance or spacing for variable-force contact 700. This may reduce a contact force at contacting surface 752 of plunger 750 in the unmated state. This may help to avoid incidental wear and prevent damage to the variable-force contact. For example, plunger 750 of variable-force contact 700 may retract and avoid damage when it is hit or struck by an object. The presence of some force may ensure that plunger 750 remains in contact with an end of barrel 720 in an unmated state. This may prevent contaminants from entering barrel 720 of the variable-force contact.

Figure 8:
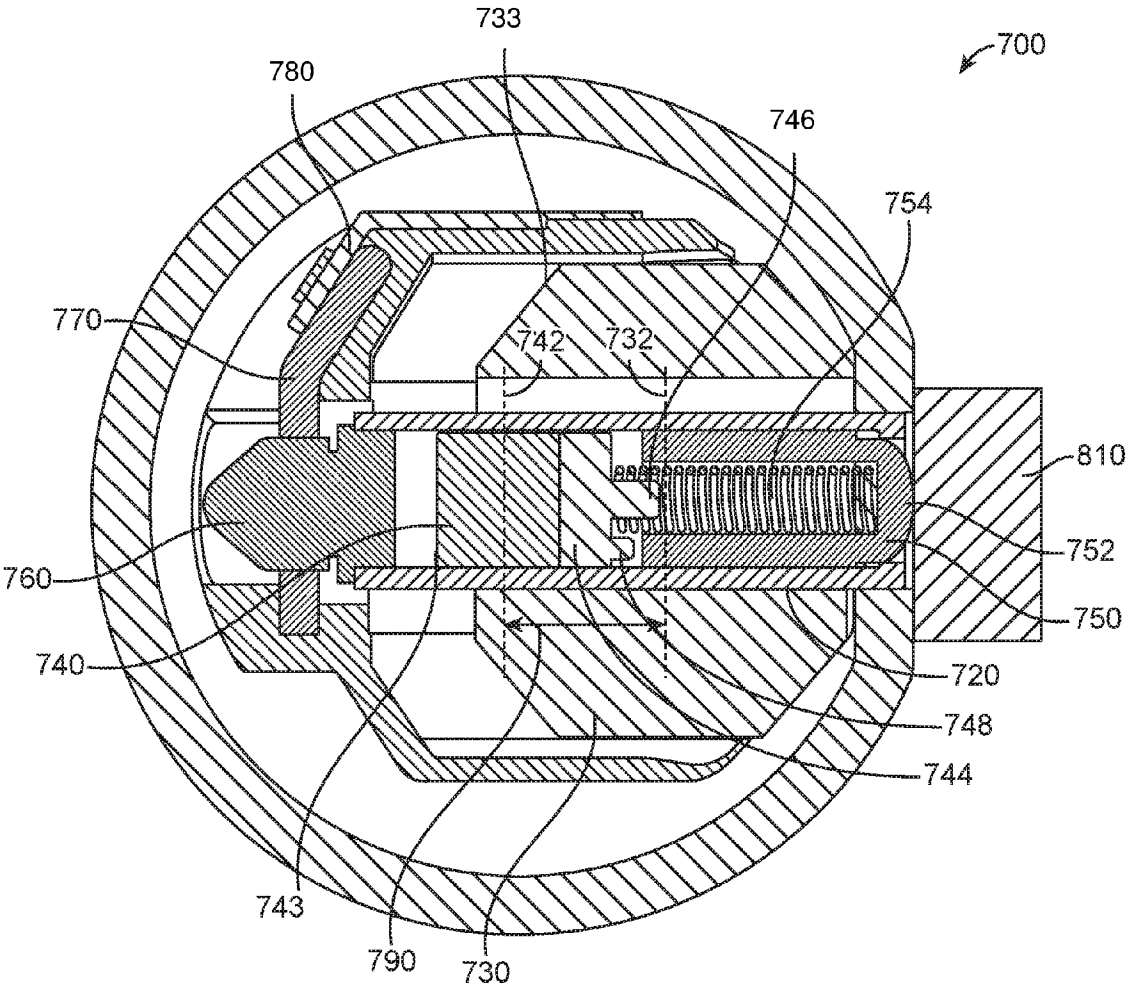
FIG. 8 illustrates the variable-force contact of FIG. 7 in a mated state.

FIG. 8 illustrates the variable-force contact of FIG. 7 in a mated state. When variable-force contact 700 is mated, shuttle magnet 730 may be attracted to a front of housing 710 by a magnetic element of a corresponding contact 810. Contact magnet 740 may be attracted to the shuttle contact such contact magnet 740 and plunger are positioned at a front of barrel 720. In this configuration, shuttle magnet 730 and contact magnet 740 may be at or near a maximum distance or spacing for variable-force contact 700. That is, a distance between center line 732 of shuttle magnet 730 and center line 742 of contact magnet 740 may be at or near a maximum distance or spacing for variable-force contact 700. This may increase a contact force at contacting surface 752 of plunger 750 in the mated state. This increase in force may reduce an impedance of a connection made between the variable-force contact 700 and corresponding contact 810. This mated contact force may be larger than the unmated contact force.

In these and other embodiments of the present invention, the mated force may be a function of the attractive magnetic force between contact magnet 740 and shuttle magnet 730. In the mated configuration, contact magnet 740 may be in a passage 737 in shuttle magnet 730. The result may be that the attractive magnetic force may be a weak function of the exact placement of contact magnet 740 relative to shuttle magnet 730. This may provide a stable contact force as the sizes and spacings of the component parts of variable-force contact 700 vary over manufacturing tolerances.

In these and other embodiments of the present invention, the variable-force contact may generate only a limited, reduced, or zero force pushing against its housing. This may stand in contrast to spring-loaded contacts that may include spring 754 that may push a device housing spring 754-loaded contact away from a corresponding mated device. This pushing may reduce a resulting contact force. By removing this push force provided by the spring, the resulting contact force may be maintained at a high level when the variable-force contact is mated.

In these and other embodiments of the present invention, when variable-force contact 700 is unmated, shuttle magnet 730 may be driven by the attractive magnetic force of contact magnet 740 to a location near a rear of housing 710. In this position, the larger shuttle magnet 730 may be further away from a surface of an electronic device housing variable-force contact 700. This may reduce stray magnetic flux at a surface of the electronic device in the unmated state. This in turn may protect against damage to magnetic stripes on credit cards and licenses and may prevent data loss in various data storage media.

In these and other embodiments of the present invention, it may be desirable that when the variable-force contact 700 is mated, current may flow through plunger 750 and into barrel 720. That is, it may be undesirable in the mated state for plunger 750 to be centered in barrel 720 and not contacting an inside edge of barrel 720, as this would create an open circuit. Accordingly, in these and other embodiments of the present invention, a surface of the protective structure 744 closest to plunger 750 may be asymmetrical, shown here and in FIG. 7 by the inclusion of feature 748. In these and other embodiments of the present invention, a backside of plunger 750 may be asymmetrical instead of the surface of the protective structure 744. Either of these may help to prevent plunger 750 from being centered in barrel 720 and creating an open circuit by having contact magnet 740 push an edge of plunger 750 into a side of barrel 720.

Figure 9:
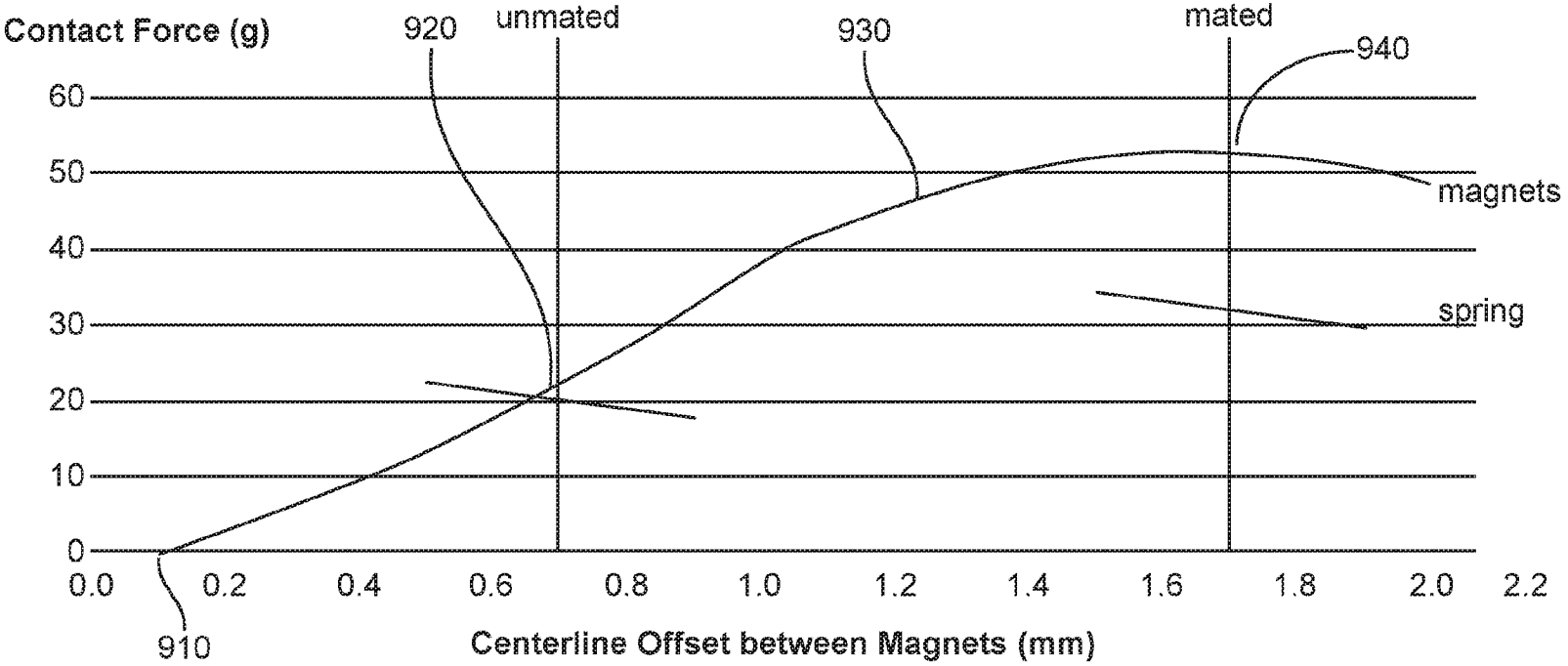
FIG. 9 illustrates a contact force curve for the magnets of the variable-force contact of FIG. 7.

FIG. 9 illustrates a contact force curve for the magnets of the variable-force contact of FIG. 7. This force curve graphs a force available at contacting surface 752 of plunger 750 as a function of a distance between center lines of contact magnet 740 and shuttle magnet 730. In this example, at point 910, contact magnet 740 may be centered in shuttle magnet 730 and thought the magnets attract, there may be little net force on the magnet. As contact magnet 740 moves out towards and edge and out of shuttle magnet 730, the force may increase to the unmated force shown at point 920. The low contact force at point 920 may help to prevent damage to variable-force contact 700. When variable-force contact 700 is connected to contact 410, the distance between centerlines of contact magnet 740 and shuttle magnet 730 may increase to point 940. Point 940 may show the mated contact force for variable-force contact 700. The rate of change of contact force near point 940 (the derivative of the curve at point 940) may be flat, meaning that changes in the distance between centerlines of contact magnet 740 and shuttle magnet 730 do not strongly effect contact force. This may allow variations in components size and spacings that may be due to manufacturing tolerances and other variables to have a limited effect on contact force. The high value may reduce contact resistance in the connection between variable-force contact 700 and contact 410.

Figure 10:
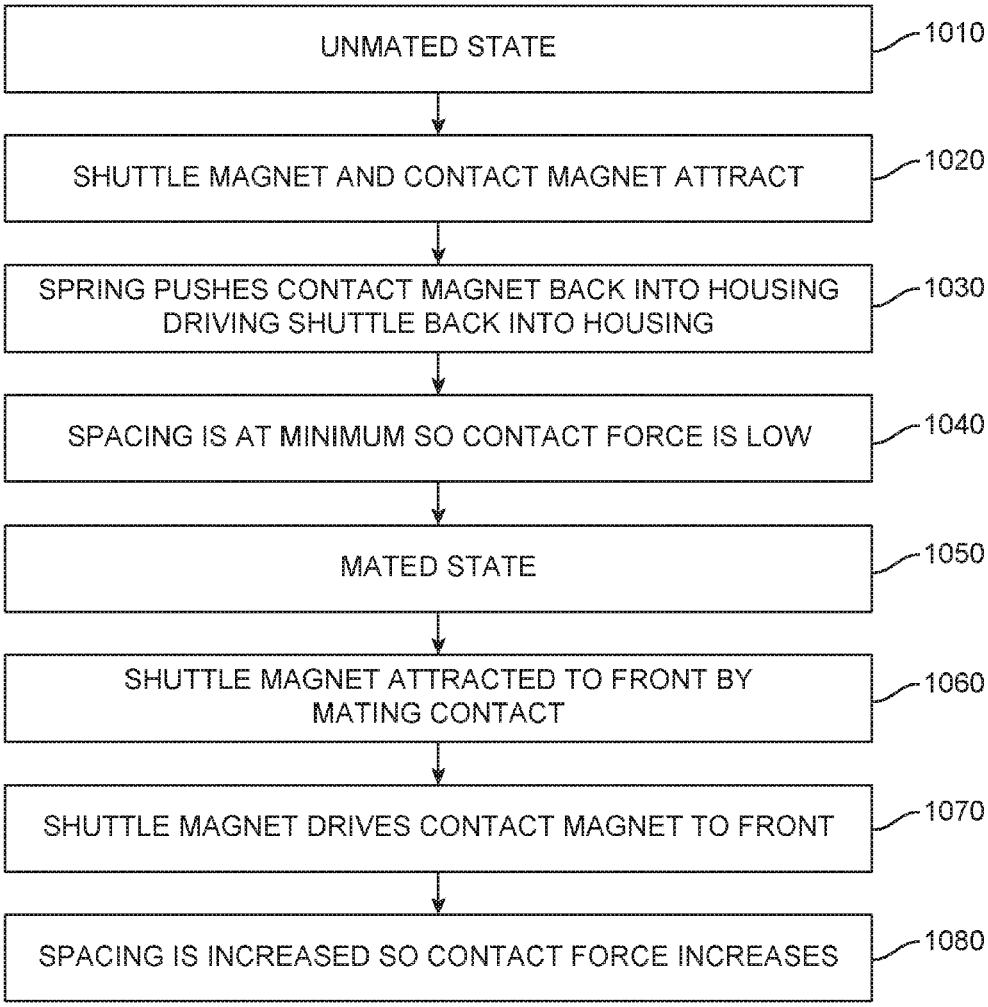
FIG. 10 is a flow chart showing the operation of the variable-force contact of FIG. 7.

FIG. 10 is a flow chart showing the operation of the variable-force contact of FIG. 3. In act 1010, variable-force contact 700 may be unmated. In act 1020, contact magnet 740 and shuttle magnet 730 may attract. Spring 754 may push contact magnet 740 back into housing 710. Shuttle magnet 740 may be driven near a rear of housing 710 in act 1030. Again, this may reduce stray flux at a surface of an electronic device housing variable-force contact 700. In act 1040, the distance between center lines 742 and 732 of contact magnet 740 and shuttle magnet 730 may be at a minimum thereby reducing the contact force.

In act 1050, variable-force contact 700 may be mated. Shuttle magnet 730 may be attracted to a front of variable-force contact 700 by a magnetic element of a connector having mating contact 410, in act 1060. Shuttle magnet 730 may drive contact magnet 740 forward in act 1070. The distance between center lines 742 and 732 of contact magnet 740 and shuttle magnet 730 may be at a maximum thereby increasing the contact force in act 1080. Again, this increased force may reduce a resistance of the connection between variable-force contact 700 and mating contact 410.

Figure 11:
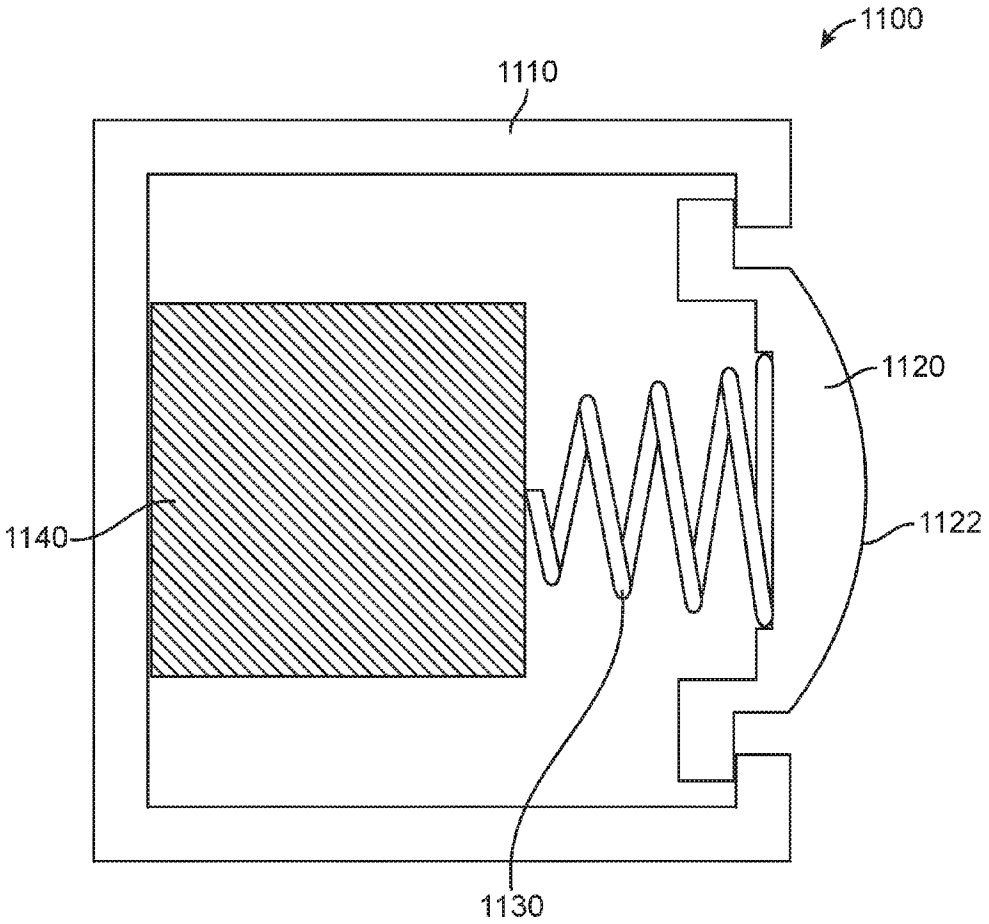
FIG. 11 illustrates another variable-force contact according to an embodiment of the present invention.

FIG. 11 illustrates another variable-force contact according to an embodiment of the present invention. Variable-force contact 1100 may include a housing (not shown). The housing may be separate from a device enclosure (not shown) or it may be the same as a device enclosure, or structures (not shown) may be shared between the housing and device enclosure. Barrel 1110 may extend laterally through the housing. Barrel 1110 may include a rear portion located in the housing and a front portion extending from a front of the housing. Plunger 1120 may be located at least partially in barrel 1110. Plunger 1120 may have contacting surface 1122 extending beyond a front of plunger 1120. Contacting surface 1122 may mate with corresponding contact surfaces of corresponding contacts in corresponding connectors. Plunger 1120 may be free to move laterally within barrel 1110. Magnet 1140 may be located in barrel 1140.

Variable-force contact 1100 may include spring 1130 between magnet 1140 and plunger 1120. When variable-force contact 1100 is in the unmated state, spring 1130 may push magnet 1140 away from plunger 1120. This may reduce a contact force at plunger 1120 in the unmated state. The repositioning of magnet 1140 away from the front of variable-force contact 1100 may reduce the stray magnetic flux at a surface of the electronic device.

Figure 12:
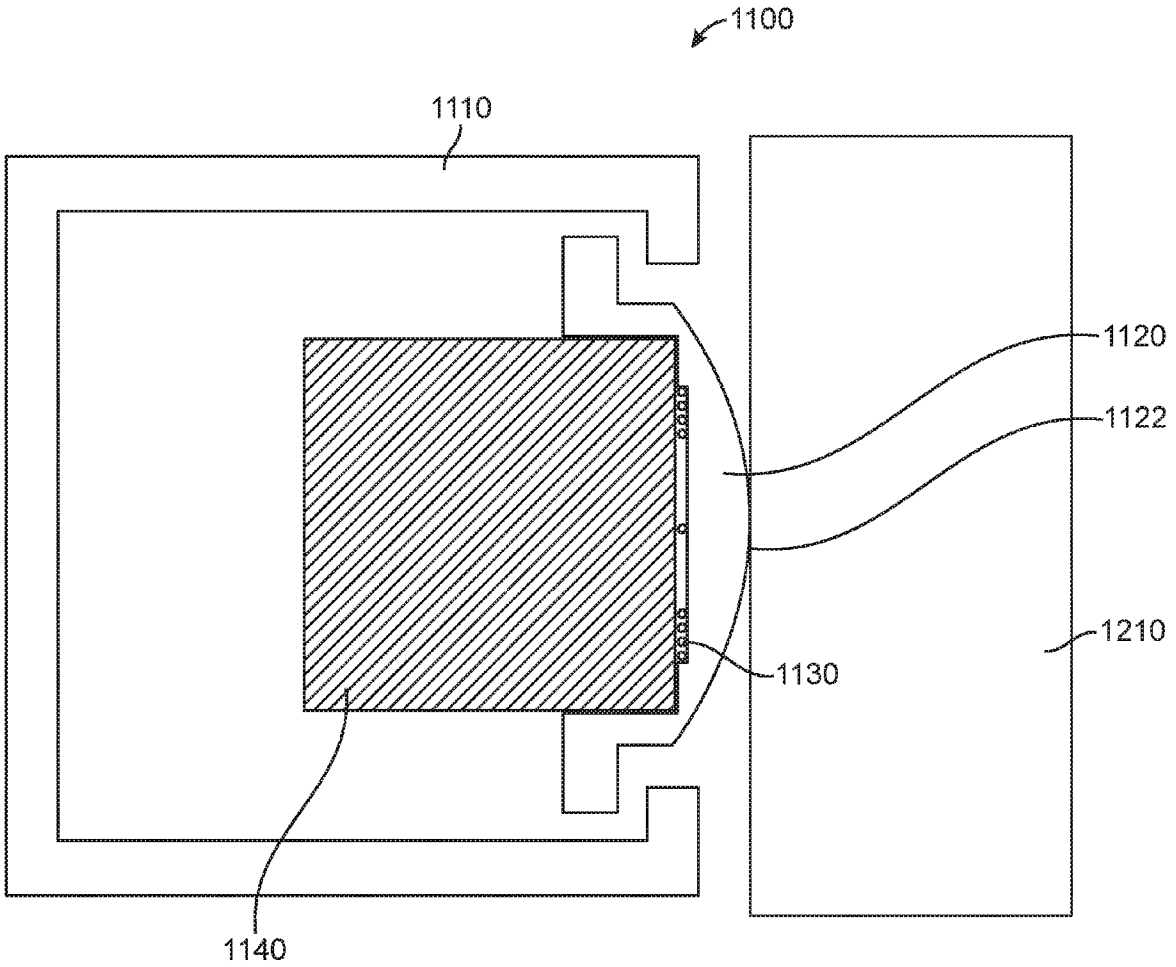
FIG. 12 illustrates the variable-force contact of FIG. 11 in a mated state.

FIG. 12 illustrates the variable-force contact of FIG. 11 in a mated state. When contact 1210 is mated to variable-force contact 1100, magnet 1140 may be attracted to a magnetic element (not shown) in the corresponding connector (not shown). Magnet 1140 may move forward against plunger 1120 thereby providing a high contacting force in the mated state.

In various embodiments of the present invention, plungers, contacts, brackets, barrels, and other conductive portions of a variable-force contact may be formed by stamping, forging, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The magnets may be rare-earth magnets or other type of magnets.

Embodiments of the present invention may provide variable-force contacts that may be used in connector receptacles and connector inserts that may be located in, may connect to, or may be on the surface of various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, styluses, remote control devices, chargers, and other devices. These variable-force contacts may provide pathways for signals that are compliant with various standards such as one of the Universal Serial Bus standards including USB Type-C, High-Definition Multimedia Interface, Digital Visual Interface, Ethernet, DisplayPort, Thunderbolt, Lightning, Joint Test Action Group, test-access-port, Directed Automated Random Testing, universal asynchronous receiver/transmitters, clock signals, power signals, and other types of standard, non-standard, and proprietary interfaces and combinations thereof that have been developed, are being developed, or will be developed in the future. Other embodiments of the present invention may provide connector structures that may be used to provide a reduced set of functions for one or more of these standards. In various embodiments of the present invention, these variable-force contacts may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A variable-force contact comprising:

a housing;

a barrel extending laterally and having a rear portion and a front portion extending from a front of the housing;

a plunger in the barrel, the plunger having a contacting surface, the plunger able to move laterally within the barrel;

a contact magnet in the barrel between the plunger and the rear portion of the barrel, the contact magnet able to move laterally within the barrel; and a shuttle magnet on at least a first side of the barrel, the shuttle magnet able to move laterally within the housing.

2. The variable-force contact of claim 1, wherein the shuttle magnet is located on at least a first side and a second side of the barrel, the first side opposite the second side.

3. The variable-force contact of claim 1, wherein the shuttle magnet and the contact magnet are concentric.

4. The variable-force contact of claim 1, wherein the shuttle magnet includes a first passage, the barrel located in the first passage.

5. The variable-force contact of claim 1, wherein the polarity of the contact magnet and the polarity of the shuttle magnet are oriented such that the shuttle magnet and the contact magnet repel.

6. The variable-force contact of claim 5, wherein when the variable-force contact is unmated, the shuttle magnet and the contact magnet repel such that the shuttle magnet moves laterally towards a rear of the housing and the contact magnet and plunger are positioned at a front the barrel.

7. The variable-force contact of claim 6, wherein when the variable-force contact is mated, the shuttle magnet is attracted to a front of the housing and the shuttle magnet and the contact magnet repel such the contact magnet and plunger are positioned at a front of the barrel.

8. The variable-force contact of claim 7, wherein when the variable-force contact is mated, the contact magnet applies a first force to the plunger, and when the variable-force contact is unmated, the contact magnet applies a second force to the plunger, the first force greater than the second force.

9. The variable-force contact of claim 8, wherein a backside of the plunger is asymmetrical.

10. The variable-force contact of claim 1, wherein the rear portion of the barrel is in the housing.

11. A variable-force contact comprising:

a housing;

a barrel extending laterally and having a rear portion and a front portion extending from a front of the housing;

a plunger in the barrel, the plunger having a contacting surface, the plunger able to move laterally within the barrel;

a contact magnet in the barrel between the plunger and the rear portion of the barrel, the contact magnet able to move laterally within the barrel;

a spring between the contact magnet and the contacting surface of the plunger; and a shuttle magnet on at least a first side of the barrel, the shuttle magnet able to move laterally within the housing.

12. The variable-force contact of claim 11, wherein the shuttle magnet is located on at least a first side and a second side of the barrel, the first side opposite the second side.

13. The variable-force contact of claim 11, wherein the shuttle magnet and the contact magnet are concentric.

14. The variable-force contact of claim 11, wherein the shuttle magnet includes a first passage, the barrel located in the first passage.

15. The variable-force contact of claim 11, wherein the polarity of the contact magnet and the polarity of the shuttle magnet are oriented such that the shuttle magnet and the contact magnet attract.

16. The variable-force contact of claim 15, wherein when the variable-force contact is unmated, the spring pushes the contact magnet and the plunger away from each other such that the contact magnet moves towards the rear portion of the barrel and plunger moves to the front of the barrel and the shuttle magnet and the contact magnet attract such that the shuttle magnet moves laterally towards a rear of the housing.

17. The variable-force contact of claim 16, wherein when the variable-force contact is mated, the shuttle magnet is attracted to a front of the housing, and the shuttle magnet and the contact magnet attract such the contact magnet pushes the plunger the front of the barrel.

18. The variable-force contact of claim 17, wherein when the variable-force contact is mated, the contact magnet applies a first force to the plunger, and when the variable-force contact is unmated, the contact magnet applies a second force to the plunger, the first force greater than the second force.

19. The variable-force contact of claim 18, wherein a backside of the plunger is asymmetrical.

20. The variable-force contact of claim 11, wherein the rear portion of the barrel is in the housing.

* * * * *